US009316041B2

(12) United States Patent
Olson et al.

(10) Patent No.: US 9,316,041 B2
(45) Date of Patent: Apr. 19, 2016

(54) ENTRY DOOR CLEARANCE SIDELIGHT

(71) Applicant: Pella Corporation, Pella, IA (US)

(72) Inventors: Matthew J. Olson, Pella, IA (US); Travis M. Eisenbarth, Pella, IA (US); Rudi Clark, Ottumwa, IA (US); Todd Leathers, Pella, IA (US); Bruce Baier, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 14/468,097

(22) Filed: Aug. 25, 2014

(65) Prior Publication Data

US 2016/0053527 A1 Feb. 25, 2016

(51) Int. Cl.

| | |
|---|---|
| ***E06B 3/36*** | (2006.01) |
| ***E06B 1/52*** | (2006.01) |
| ***E06B 1/60*** | (2006.01) |
| ***E06B 1/70*** | (2006.01) |
| ***E06B 7/14*** | (2006.01) |
| ***E06B 7/28*** | (2006.01) |

(52) U.S. Cl.

CPC . *E06B 3/365* (2013.01); *E06B 1/52* (2013.01); *E06B 1/6023* (2013.01); *E06B 1/70* (2013.01); *E06B 7/14* (2013.01); *E06B 7/28* (2013.01)

(58) Field of Classification Search

CPC ..... E06B 3/362; E06B 3/365; E06B 7/28; E06B 1/52; E06B 1/70; E06B 7/14; E06B 1/6023

See application file for complete search history.

(56) References Cited

U.S. PATENT DOCUMENTS

| | | | | |
|---|---|---|---|---|
| 3,919,808 | A | 11/1975 | Simmons | |
| 4,052,819 | A | 10/1977 | Beischel et al. | |
| 4,573,287 | A | 3/1986 | Hagemeyer et al. | |
| 4,644,696 | A | 2/1987 | Bursk et al. | |
| 5,822,923 | A | 10/1998 | Governale | |
| 6,453,616 | B1 | 9/2002 | Wright | |
| 6,491,326 | B1 * | 12/2002 | Massey | E05C 1/04 292/162 |
| 7,788,863 | B2 * | 9/2010 | Pepper | E06B 3/365 49/467 |
| 7,895,801 | B2 * | 3/2011 | White | E06B 1/524 52/455 |
| 8,127,511 | B2 * | 3/2012 | White | E06B 1/524 52/455 |
| 8,307,595 | B2 * | 11/2012 | White | E06B 1/524 52/455 |
| 8,490,332 | B2 * | 7/2013 | Van Camp | E06B 1/70 49/468 |
| 8,499,516 | B2 * | 8/2013 | White | E06B 1/524 52/455 |
| 8,567,128 | B2 * | 10/2013 | Van Camp | E06B 1/70 49/468 |
| 8,813,459 | B2 * | 8/2014 | White | E06B 1/524 29/897.312 |
| 8,850,744 | B2 * | 10/2014 | Bauman | E05C 9/1841 292/32 |
| 8,966,823 | B1 * | 3/2015 | Van Camp | E06B 1/70 49/467 |
| 9,051,777 | B2 * | 6/2015 | Van Camp | E06B 1/70 49/469 |
| 2003/0052492 | A1 * | 3/2003 | Massey | E05C 1/04 292/341.15 |
| 2004/0200152 | A1 * | 10/2004 | Khanlarian | E06B 1/70 49/468 |
| 2004/0200153 | A1 * | 10/2004 | Khanlarian | E06B 1/70 49/468 |

(Continued)

*Primary Examiner* — Rodney Mintz
(74) *Attorney, Agent, or Firm* — Faegre Baker Daniels LLP

(57) ABSTRACT

A building entryway assembly has the appearance of a fixed sidelight and the functionality of a hinged sidelight. The building entryway assembly includes a hinged main entryway door and at least one hinged sidelight having a lock side that meets the lock side of the main door, such that the sidelight can be selectively opened in addition to the main door when needed to expand the entryway access area. An astragal is fixed to an outer surface of the sidelight at its lock side, and the door threshold includes an astragal boot which aligns with the sidelight astragal when the sidelight is in its closed position. When so aligned, the astragal and astragal boot have the appearance of a fixed astragal extending from the threshold to the header, such that the sidelight appears to be a standard fixed unit with its hinged functionality disguised.

19 Claims, 11 Drawing Sheets

(56) References Cited

U.S. PATENT DOCUMENTS

2004/0256858 A1* 12/2004 Governale ..... E05C 1/06 292/1
2007/0079557 A1* 4/2007 Pepper ..... E06B 3/365 49/367
2008/0028701 A1* 2/2008 White ..... E06B 1/524 52/207
2008/0229668 A1* 9/2008 Meeks ..... E05C 1/02 49/367
2010/0107503 A1* 5/2010 Chapman ..... E05C 1/04 49/365
2012/0180397 A1* 7/2012 Van Camp ..... E06B 3/9632 49/467
2013/0067823 A1* 3/2013 White ..... E06B 1/524 49/506
2013/0091776 A1* 4/2013 Van Camp ..... E06B 1/70 49/467
2013/0247471 A1* 9/2013 Van Camp ..... E06B 3/9632 49/469
2013/0312335 A1* 11/2013 White ..... E06B 1/524 49/506
2014/0026489 A1* 1/2014 Bauman ..... E05C 9/1841 49/394
2014/0318021 A1* 10/2014 Van Camp ..... E06B 1/70 49/469
2015/0052820 A1* 2/2015 Van Camp ..... E06B 1/70 49/468

* cited by examiner

ENTRY DOOR CLEARANCE SIDELIGHT

BACKGROUND

1. Technical Field

The present disclosure relates to an entry door for a building and, in particular, to an entry door with at least one sidelight which can be selectively opened to increase the entryway area.

2. Description of Related Art

Doorways used for residential and/or commercial structures are often the primary, or sole, access points for moving bulky material such as furniture or equipment into and out of the structure. For example, the main entryway for a building (e.g., the front door of a home) is often the point of access to the structure for larger items such as couches, tables and the like. In some other instances, double doors may be provided such that both doors can be opened to create a double-width entryway to allow such large items into and out of the building. While such double doors are effective at creating a large access area, they are sometimes disfavored for residential construction for aesthetic, cost and/or security reasons.

Another consideration in designing building entryways, aside from the size and area of the access opening, is allowing natural light into the building structure at the entryway area. In some buildings, particularly for residential construction, sidelights are provided on either side of the main entryway door. Such sidelights are typically narrower than the door itself, such as about 12-20 inches, and can include inlaid glass to allow light ingress at the left and right sides of the door. In addition, sidelights may be chosen for their aesthetic appeal, particularly where the sidelights are designed to offer a symmetrical and pleasing framework around the main building entryway.

SUMMARY

The present disclosure provides a building entryway assembly with the appearance of a fixed sidelight and the functionality of a hinged sidelight. The building entryway assembly includes a hinged main entryway door and at least one hinged sidelight having a lock side that meets the lock side of the main door, such that the sidelight can be selectively opened in addition to the main door when needed to expand the entryway access area. An astragal is fixed to an outer surface of the sidelight at its lock side, and the door threshold includes an astragal boot which aligns with the sidelight astragal when the sidelight is in its closed position. When so aligned, the astragal and astragal boot have the appearance of a fixed astragal extending from the threshold to the header, such that the sidelight appears to be a standard fixed unit with its hinged functionality disguised.

In one form, the present disclosure provides a building entryway assembly disposable between an interior and exterior of a building space, the assembly comprising: a door frame positionable between the interior and the exterior of the building space, the door frame having upwardly extending first and second jambs, and a threshold and header extending between lower and upper ends of the first and second jambs respectively; a main door having a hinge side and a lock side, the hinge side of the main door hinged to the first jamb to define a closed position in which the main door is substantially flush with the door frame and an open position in which the main door is swiveled into the interior of the building space; a sidelight having a hinge side and a lock side, the hinge side of the sidelight hinged to the second jamb to define a closed position in which the sidelight is substantially flush with the door frame and an open position in which the sidelight is swiveled into the interior of the building space; an astragal fixed to the lock side of the sidelight and protruding outwardly away from an outer surface of the sidelight; and an astragal boot fixed to the threshold of the door frame and positioned to align with the astragal when the sidelight is in its closed position.

In another form, the present disclosure provides a door assembly comprising: a door frame having a threshold with an outwardly extending, downwardly sloped surface; a main door hinged to the door frame via a main hinge, the main door defining a closed position and an open position; a sidelight mounted to the door frame via a sidelight hinge, the sidelight defining a closed position and an open position; and an astragal assembly comprising: an astragal fixed to the sidelight and extending upwardly from a bottom surface of the sidelight to a top surface of the sidelight, the astragal protruding outwardly away from an outer surface of the sidelight and disposed the interface of the main door and the sidelight when the main door and the sidelight are in their respectively closed positions; and an astragal boot fixed to the outwardly extending, downwardly sloped surface of the threshold, the astragal boot aligned with the astragal when the sidelight is in its closed position such that the astragal assembly appears to extend from the threshold to an upper surface of the sidelight.

In yet another form, the present disclosure provides a door assembly comprising: a door frame having a first jamb, a second jamb, a sill, and a head; a first panel having a first side hinged to the first jamb and a second side; a second panel having a first side hinged to the second jamb and a second side positioned adjacent the second side of the first panel when the first and second panels are in their respective closed positions, the second panel having an astragal member secured along the second side of the second panel; and an astragal boot secured between the astragal member of the second panel and the sill of the door frame.

BRIEF DESCRIPTION OF THE DRAWINGS

The above-mentioned and other features and advantages of the present disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION

Figure 1:
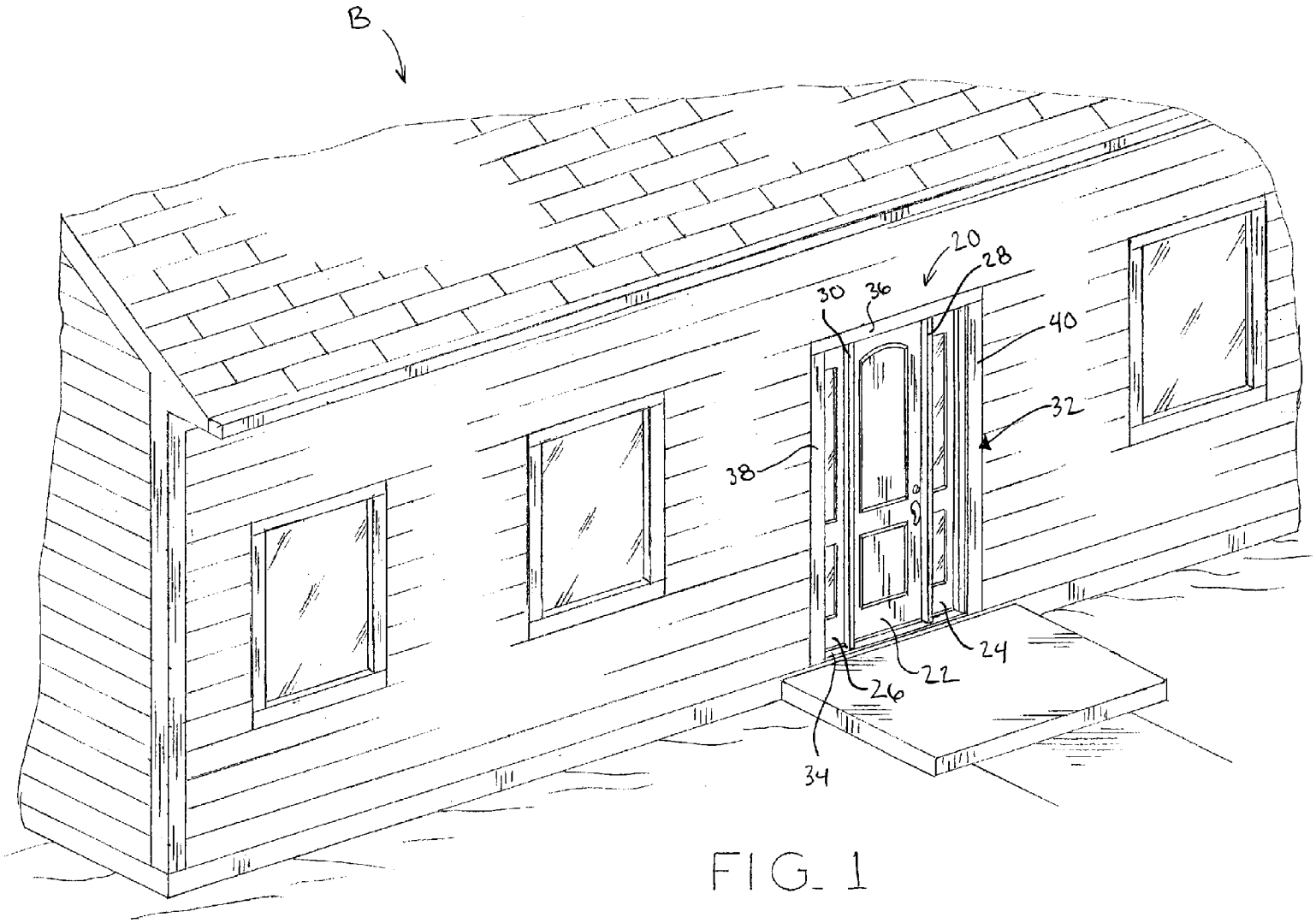
FIG. 1 is a partial perspective view of a building including an entryway assembly in accordance with the present disclosure.

Referring to FIG. 1, building B is illustrated with entryway assembly 20, which includes a plurality of entryway panels including main door 22, a first sidelight 24 on the lock side of the main door 22, and a second sidelight 26 on the opposing, hinged side of the main door 22. A lock-side astragal 28 is provided at the junction between main door 22 and sidelight 24, while a hinge-side astragal 30 is provided at the junction between main door 22 and sidelight 26. Sidelights 24 and 26 are complementary to one another (e.g., symmetrical), as are astragals 28 and 30, so that a symmetrical and balanced overall appearance of entryway assembly 20 is presented to a viewer positioned outside building B. As described in detail below, lock-side astragal 28 and its attached/mating sidelight 24 are hinged to swivel inwardly toward the interior of building B, but are arranged to present an appearance nearly identical to (and therefore, symmetrical with) fixed astragal 30 and its attached/mating sidelight 26.

Entryway assembly 20 further includes door frame 32 including threshold 34, header 36, left side jamb 38 and right side jamb 40. In the illustrated embodiment, door frame 32 forms a generally rectangular structure in which left and right jambs 38, 40 extend substantially vertically between the respective left and right ends of threshold 34 and header 36, which extend substantially horizontally. Of course it is contemplated that door frame 32 may take other shapes and forms as required or desired for a particular application.

Figure 2:
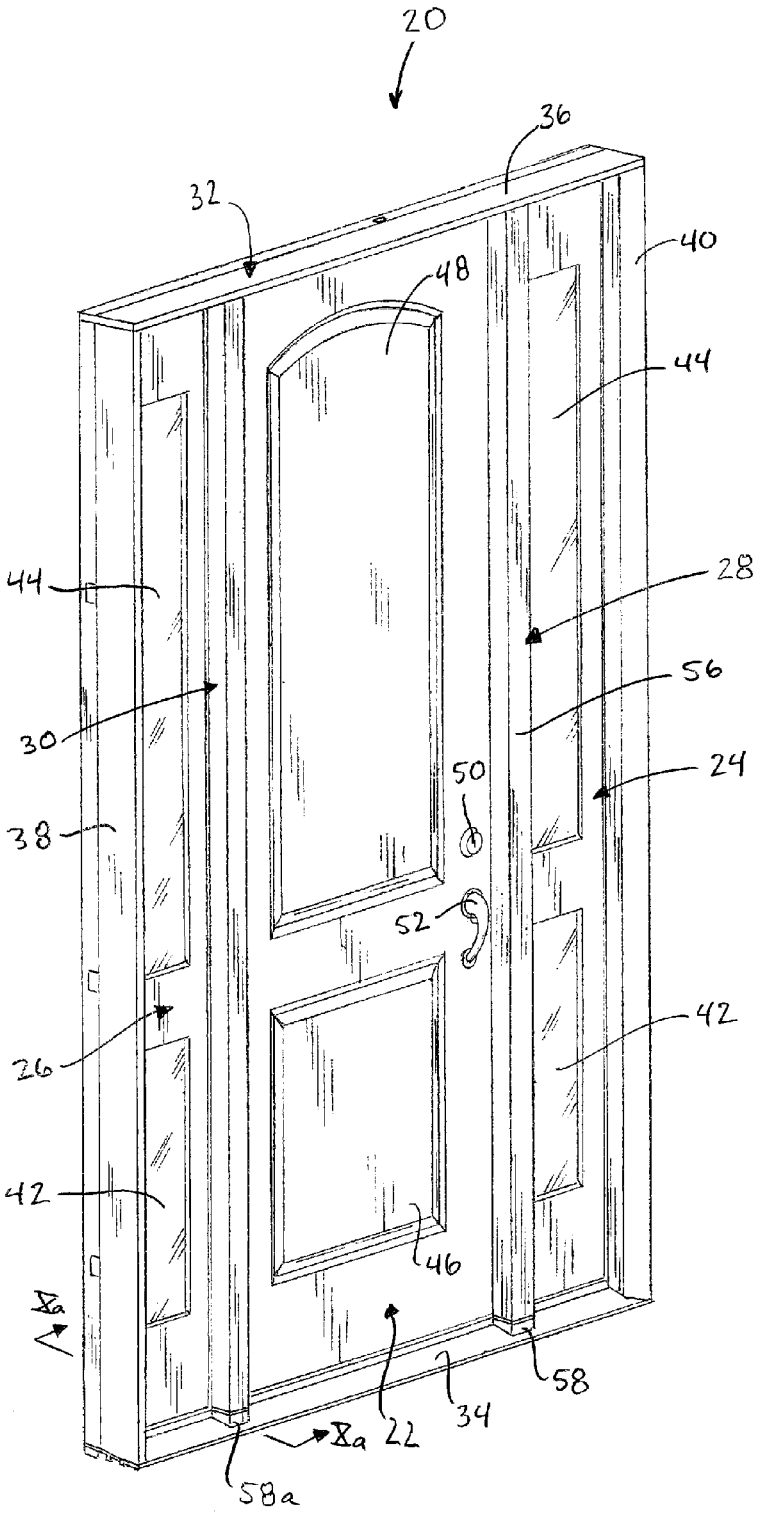
FIG. 2 is an exterior perspective view of the entryway assembly shown in FIG. 1.

FIG. 2 illustrates entryway assembly 20 divorced from building B. In use, a fenestration may be provided in a wall of building B at a desired location of an appropriate size to fit entryway assembly 20, such that entryway assembly 20 may be provided as a finished and assembled unit for on-site integration into building B.

In the illustrated embodiment of FIG. 2, sidelight 24 and sidelight 26 each include lower and upper window panes 42, 44 to admit light through entryway assembly 20 on either side of main door 22. However, sidelights 24, 26 need not include any transparent or translucent panels. Similarly, lower and upper panels 46, 48 formed in main door 22 may or may not admit light therethrough.

FIG. 2 illustrates an exterior portion of entryway assembly 20, i.e., the surfaces of main door 22 and sidelights 24, 26 which are adapted to face toward open air and away from building B. Lock 50 and handle 52 are provided in main door 22 along the lock side thereof to restrict entry to key holders, and all door hinges 54 (FIG. 3) are not accessible from the exterior side so as to prevent tampering. In addition, astragals 28 and 30 are located at the exterior side of entryway assembly 20 to provide a physical barrier to weather, moisture and air through the gaps between main door 22 and sidelights 24, 26 respectively. Astragals 28 and 30 also present a clean and finished appearance (e.g., by hiding weather seals) and deter tampering with any lock mechanisms or hinges from the outside of building B.

Lock-side astragal 28 is formed as an astragal assembly including a main astragal portion 56 and an astragal boot 58. As described in further detail below, a lower end of main astragal portion 56 terminates well above the upper surface of threshold 34 to allow sidelight 24 to pivot inwardly toward the interior of building B without spatial interference between structures of threshold 34 and main astragal 56. In one embodiment, main astragal 56 extends from the bottom surface to the top surface of sidelight 24. Astragal boot 58, shown in FIGS. 2 and 10 and described further below, occupies the gap between the lower end of main astragal 56 and threshold 34 and extends upwardly from the upper surface of threshold 34 to nearly abut the lower end of main astragal 56. Together, main astragal 56 and astragal boot 58 cooperate to give the appearance of fixed astragal extending the entire distance from threshold 34 to header 36, similar to astragal 30.

On the other hand, hinge-side astragal 30 is a fixed structure which extends from the upper surface of threshold 34 to the lower surface of header 36. In order to promote a symmetrical appearance between the fixed hinge-side astragal 30 and the moveable astragal 56 and boot 58, astragal 30 may also include a fixed-side astragal boot 58*a*, shown in FIGS. 2 and 10A and described in further detail below. Alternatively, hinge-side astragal 30 may be a monolithic solid piece of material which extends the entire distance from the upper surface of threshold 34 to the lower surface of header 36.

Figure 3:
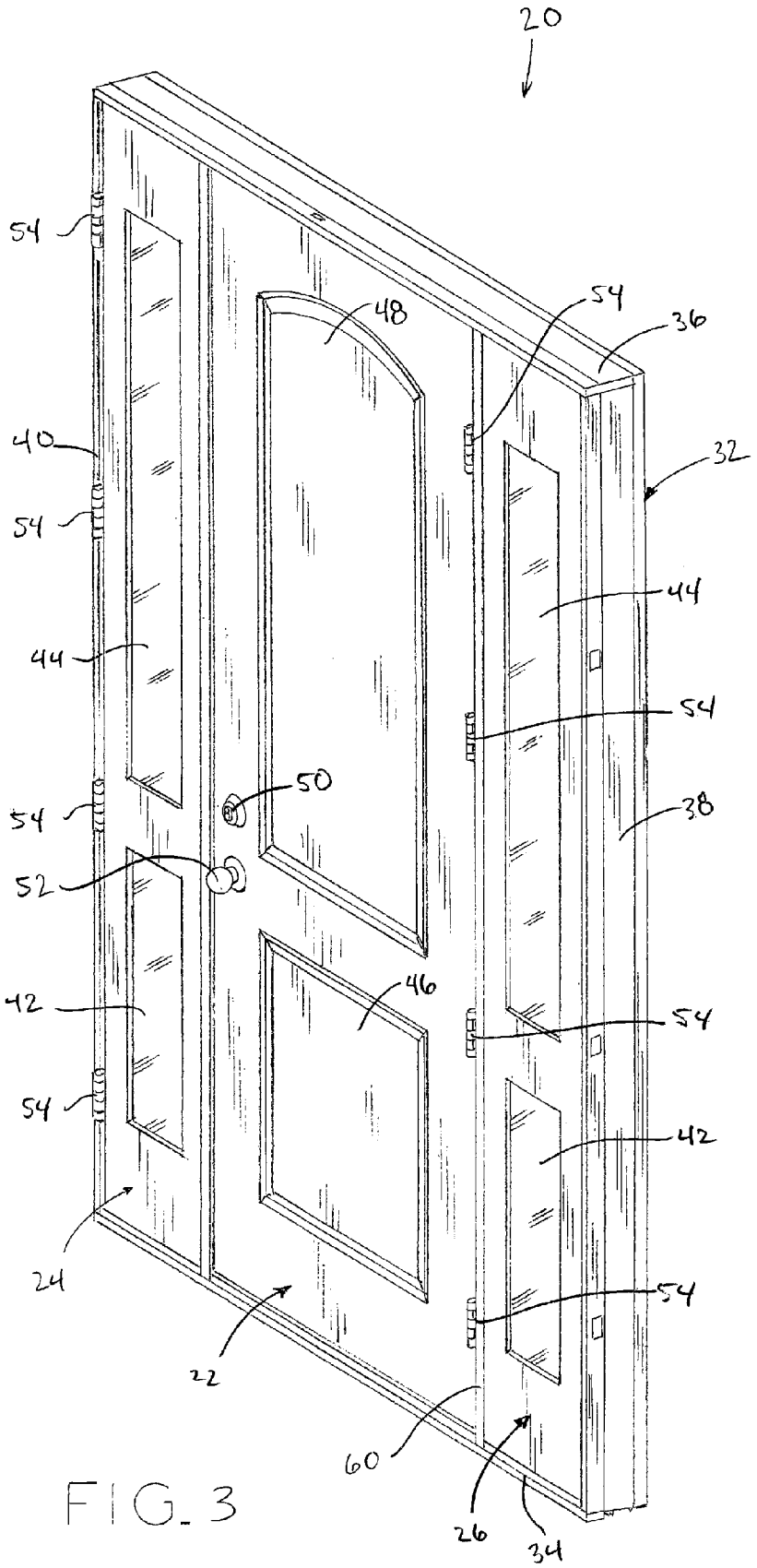
FIG. 3 is an interior perspective view of the entryway assembly shown in FIG. 1.
Figure 4:
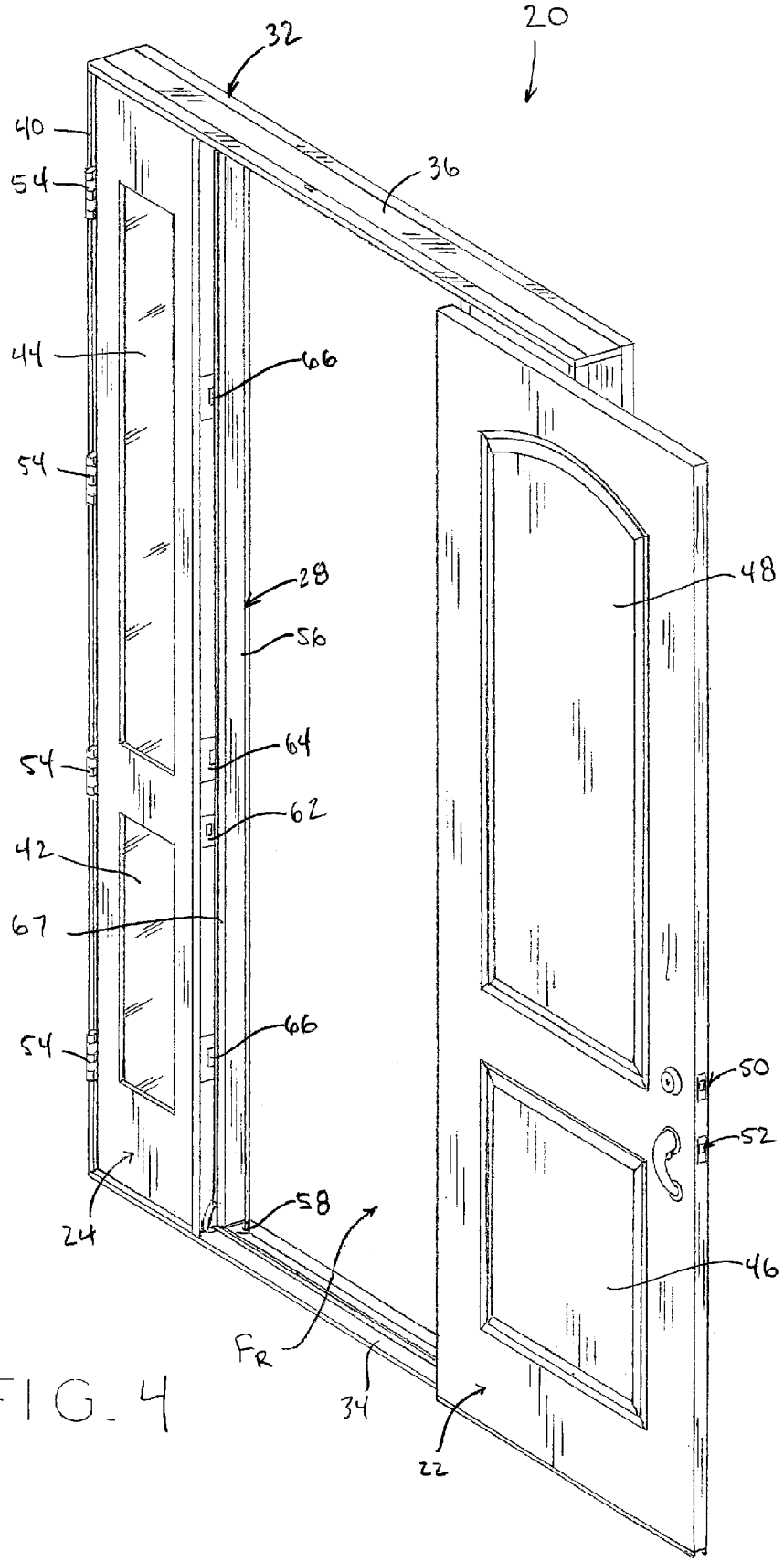
FIG. 4 is another view of the entryway assembly shown in FIG. 3, with the main door swiveled open.
Figure 5:
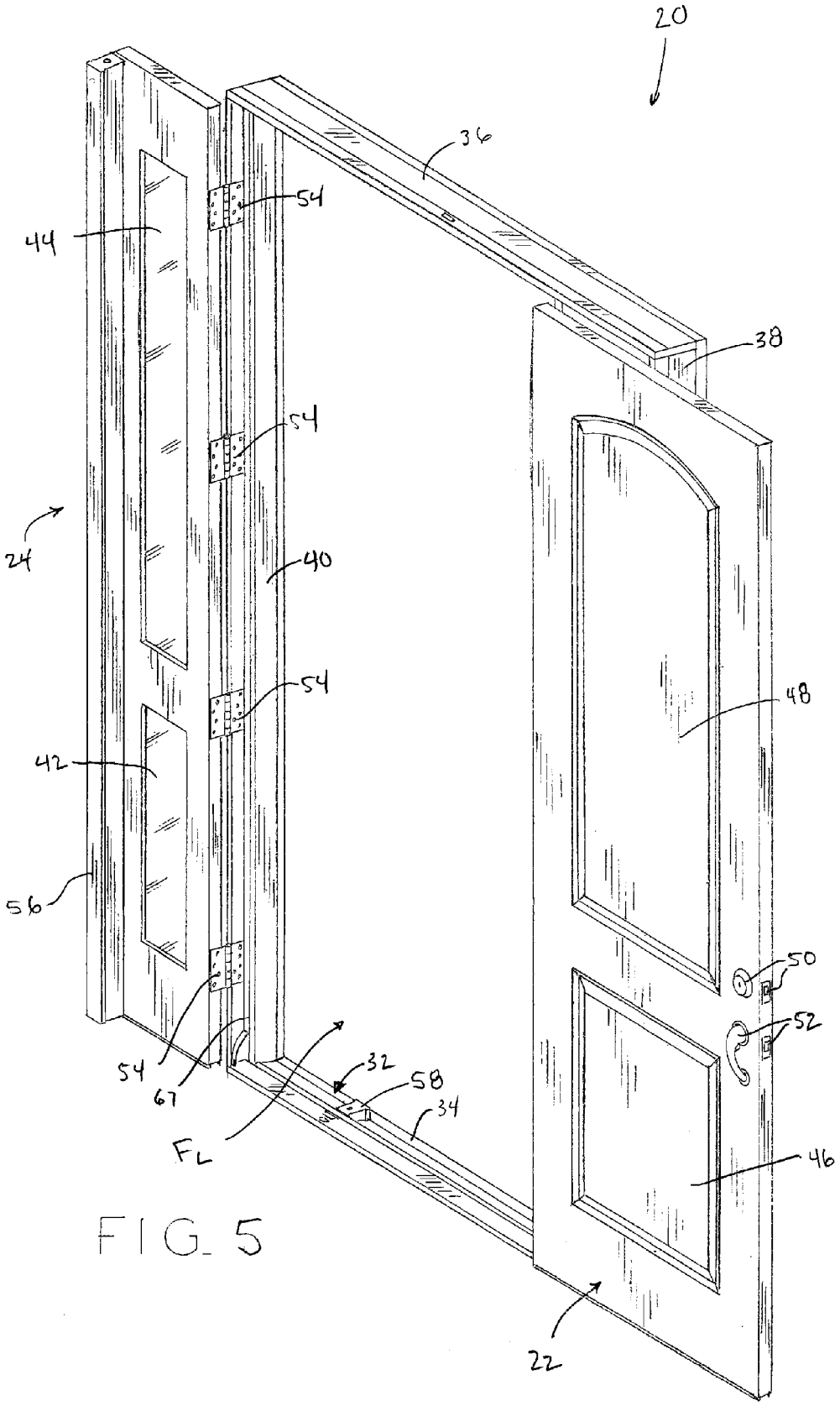
FIG. 5 is another view of the entryway assembly shown in FIG. 3, with both the main door and the sidelight swiveled open.

FIGS. 3 and 4 illustrate entryway assembly 20 as it appears from the inside of building B, with main door 22 closed (i.e., substantially flush with door frame 32 as shown in FIG. 3) and fully open (FIG. 4). Main door 22 is attached to hinge side sidelight 26 via a plurality (e.g., four) of hinges 54 so that main door 22 may be swiveled into the interior of building B to a fully open position as shown in FIG. 4. In the illustrated embodiment of FIG. 3, sidelight 26 is fixed (i.e., not hinged) to door frame 32, such as by being screwed and/or adhesively connected to left side jamb 38, header 36 and/or threshold 34. Because sidelight 26 is not moveable, sidelight 26 may be considered to be a portion of the wall of building B, and indeed may be completely omitted within the scope of the present disclosure. Accordingly, although fixed sidelight 26 is shown and described as being disposed between the hinged side of main door 22 and left side jamb 38 of door frame 32, it can also be said that intermediate frame member 60 disposed between sidelight 26 and main door 22, to which hinges 54 are fixed, constitutes the "left jamb" of door frame 32 for purposes of the embodiment shown in FIG. 3.

During normal use of entryway assembly 20, main door 22 may need to be the only door which is opened and closed with regularity. During such normal use, lock-side sidelight 24 acts as a fixed sidelight, similar to fixed sidelight 26. In particular, sidelight 24 may provide strike plate 62 to mate with a door latch connected to handle 52, as well as deadbolt receiver 64 positioned to receive the deadbolt of lock 50 when door 22 is closed and locked. Weather seal 67 may also be fixed to sidelight 24 in the gap between main door 22 and sidelight 24, as illustrated in FIG. 4, such that weather seal 67 is compressed between an abutting outer surface of main door 22 and an adjacent inwardly-facing surface of astragal 28 to form a moisture and air resistant barrier within the door gap.

Figure 6:
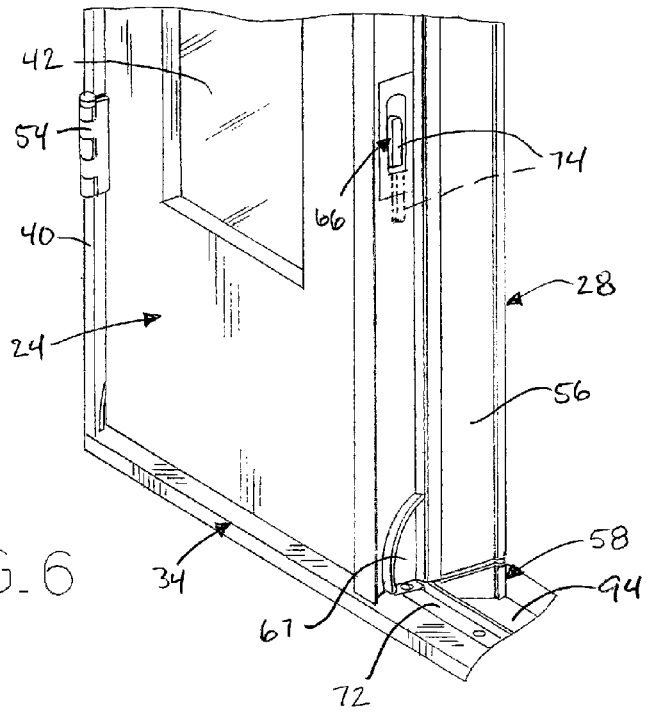
FIG. 6 is an enlarged view of a portion of the entryway assembly shown in FIG. 4.
Figure 10:
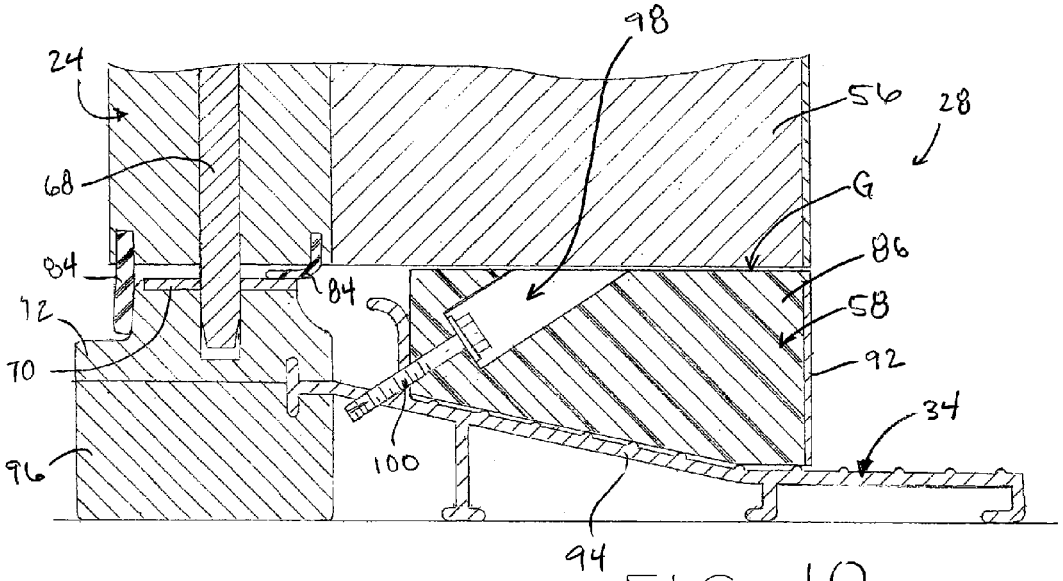
FIG. 10 is an elevation, partial cross-section view of the portion of the entryway assembly shown in FIG. 8, taken along line X-X of FIG. 8.

In order to enable the above-described "fixed sidelight" functionalities in the otherwise moveable sidelight 24, lock actuators 66 are provided along the edge of sidelight 24 (FIG. 6) facing toward regular entry fenestration $F_R$. Actuation of lower lock actuator 66 is accomplished by manipulation of actuator lever 74 from the unlocked position, shown in dashed lines of FIG. 6, to the locked position, shown in solid lines. This actuation advances a sidelight flush bolt 68 downwardly through a flush bolt strike plate 70, as best seen in FIG. 10, and into an aperture formed in threshold trim 72. A similar flush bolt system may be actuated by operation of the upper lock actuator 66 (FIG. 4). When lock actuators 66 are placed in their respective locked positions, sidelight 24 is prevented from pivoting about hinges 54 and rendered immovable, such that sidelight 24 functions as a fixed sidelight.

On occasion, it may be desirable to expand the area of regular entry fenestration $F_R$ (FIG. 4). To accomplish this, sidelight 24 may be unlocked from door frame 32 by actuation of lock actuators 66, as described above, which withdraws sidelight flush bolt 68 upwardly away from flush bolt strike plate 70 and frees sidelight 24 to pivot about door hinges 54 mounted at right side jamb 40. Specifically, sidelight 24 may be pivoted inwardly from its closed position (i.e., the position in which sidelight 24 is substantially flush with door frame 32, as shown in FIG. 4) toward the interior of building B. Sidelight 24 opens together with main astragal 56, to expose an enlarged fenestration $F_L$ through entryway assembly 20. Notably, because main astragal 56 does not extend downwardly past the highest point of threshold 34 (i.e., the upper surface of threshold trim 72 as best seen in FIG. 10), the inward swiveling of sidelight 24 is not impeded by any spatial conflict between main astragal 56 and threshold 34. The expanded area of enlarged fenestration $F_L$ facilitates passage of materials through entryway assembly 20 which would not otherwise be possible through regular entry fenestration $F_R$.

Figure 7:
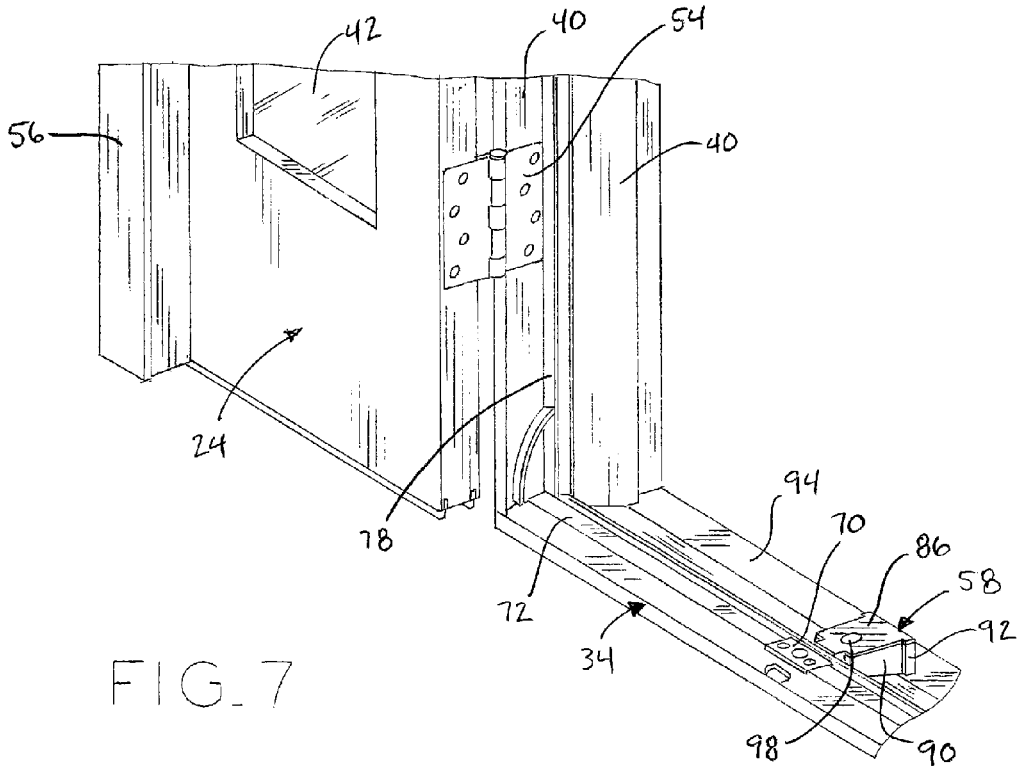
FIG. 7 is an enlarged view of a portion of the entryway assembly shown in FIG. 5.
Figure 8:
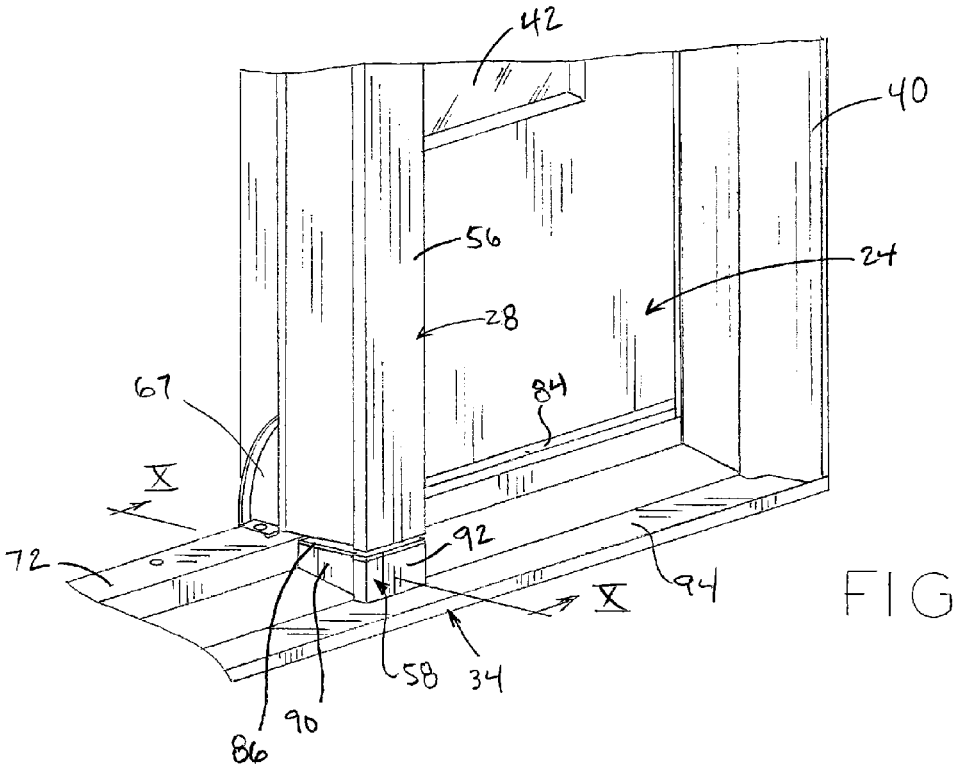
FIG. 8 is an enlarged view of a portion of the entryway assembly shown in FIG. 2, with the main door swiveled open and the sidelight remaining closed.
Figure 9:
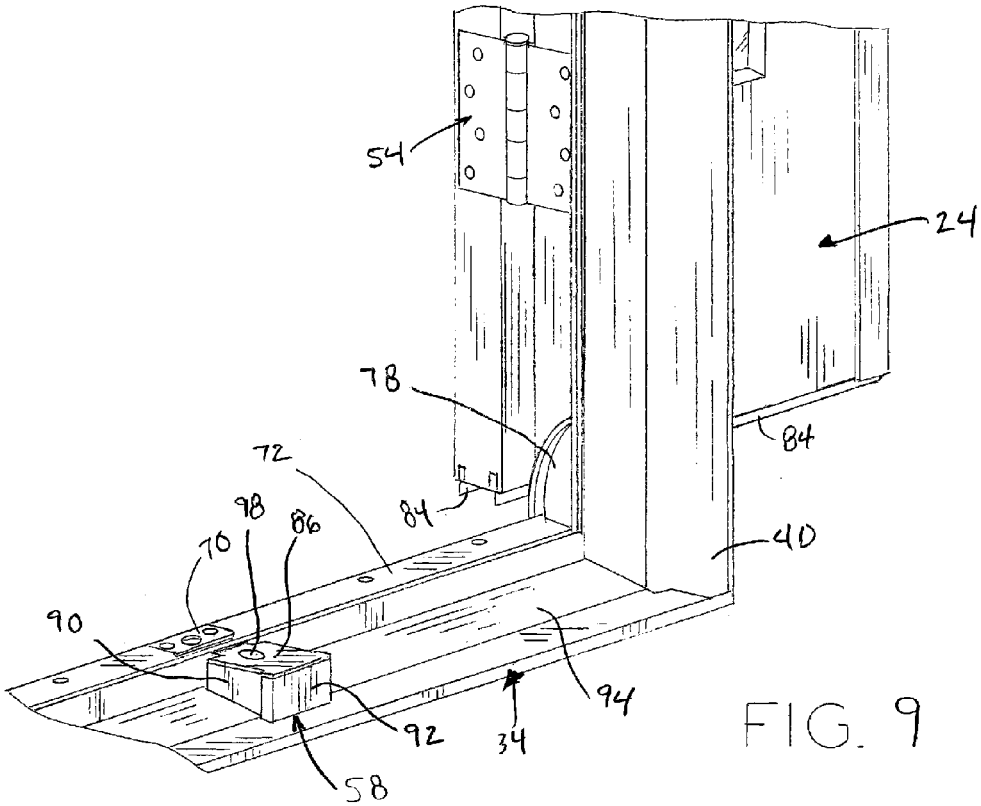
FIG. 9 is another view of the portion of the entryway assembly shown in FIG. 8, with the sidelight swiveled open.

As noted above and best seen in FIGS. 8 and 10, the alignment of astragal boot 58 with main astragal 56 (when sidelight 24 is closed) presents a substantially unbroken and continuous appearance of moveable astragal 28 that it is similar to fixed astragal 30 from the outside of building B. In addition, additional structures may be employed to ensure full functionality of moveable sidelight 24 as a door-like structure. For example, as best seen in FIG. 7, weather seal 78 may be provided in the space between the inwardly facing surface of right jamb 40 and the adjacent outwardly facing surface of sidelight 24 when sidelight 24 is in its closed position. Attached to a lower edge of lock-side sidelight 24 is a pair of lower weather seals 84 sized and positioned to abut threshold trim 72 when sidelight 24 is in the closed position, as best seen in FIG. 10.

Figure 14:
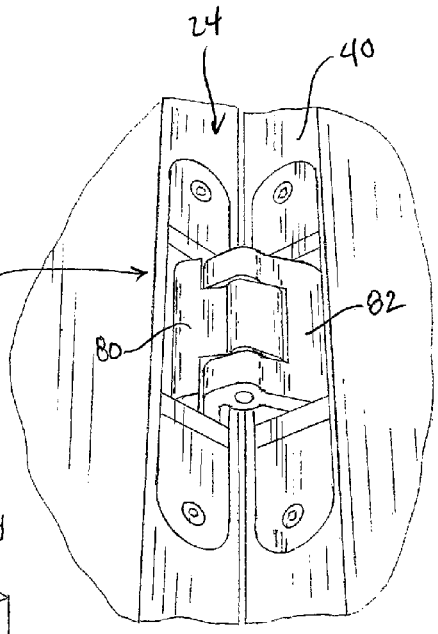
FIG. 14 is a perspective view of a hidden hinge assembly useable with entryway assemblies in accordance with the present disclosure.

Additional structures may be employed to further conceal the moveable functionality of sidelight 24. For example, hinges 54 positioned to attach moveable sidelight 24 to right side jamb 40 may be replaced with hidden hinges 54A shown in FIG. 14. Hidden hinges 54A include a door-side hinge portion 80 and a corresponding frame-side hinge portion 82 which are capable of sliding into and out of a slot formed within sidelight 24 and right jamb 40, respectively, as sidelight 24 is open and closed. Each hinge portion 80, 82 is hinged to the other, such that sidelight 24 is hinged to door frame 32 in a functionally similar fashion to the hinged connection using hinges 54 as described above, except no portion of hidden hinge 54A is visible from either side of sidelight 24 when it is in its closed position.

Figure 11:
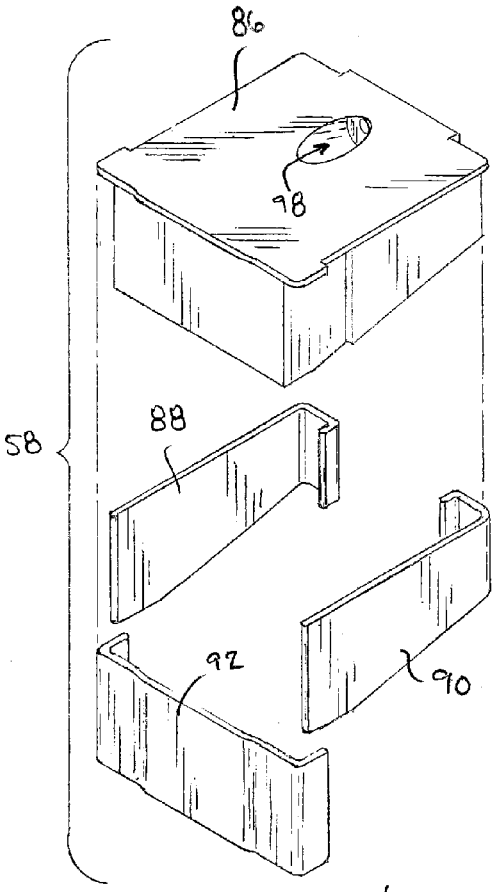
FIG. 11 is a perspective exploded view of an astragal boot assembly in accordance with the present disclosure.
Figure 12:
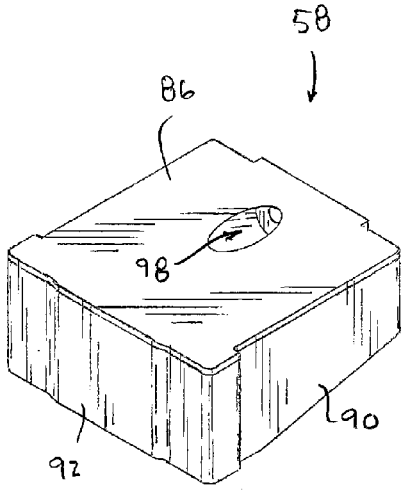
FIG. 12 is an assembled view of the astragal boot assembly shown in FIG. 11.

Turning now to FIGS. 11 and 12, astragal boot 58 is shown in detail. In the illustrated embodiment of FIG. 11, astragal boot 58 is an assembly including main body 86, left and right side cladding 88 and 90, and outer cladding 92. Main body 86 is made from a base material, such as plastic or wood, while cladding 88, 90, 92 are made from any suitable material, such as aluminum, and may be designed to provide a visual match to the cladding and/or material used for main astragal 56. Moreover, cladding 88, 90, 92 attached to an outer surface of main body 86, as shown in FIG. 12, to define a transverse cross-section which is substantially identical to the corresponding transverse cross-section of main astragal 56, so that when main astragal 56 is longitudinally aligned with astragal boot 58 (i.e., when sidelight 24 is in its closed position as described in detail above), the outer surface of astragal boot 58 has a substantially identical appearance to the corresponding adjacent outer surface of main astragal 56.

Turning again to FIG. 10, a tapered transverse profile of astragal body 86 and left and right side cladding 88, 90 are illustrated. Specifically, a lower surface of astragal boot 58 is sloped to correspond with a corresponding downward slope angle of the exterior threshold component 94 of threshold 34, such that the upper surface of astragal boot 58 remains flat and level when astragal boot 58 is fixed to threshold 34. In one embodiment, exterior component 94 is formed as an aluminum extrusion having a T-shaped interior edge which affixes to threshold base 96 and threshold trim 72, which is itself affixed to threshold base 96 (e.g., by adhesive).

Astragal boot 58 is held in place by affixation to exterior threshold component 94. In the illustrated embodiment, main body 86 includes a counterbore 98 which receives a fastener 100 as best seen in FIG. 10. Counterbore 98 is sufficiently deep to fully receive the head of fastener 100, such that the top surface of astragal boot 58 is planar except for the interruption of counterbore 98, such that the correspondingly flat lower surface of main astragal 56 can abut or nearly abut the correspondingly flat upper surface of main body 86 when sidelight 24 is in the closed position. In the illustrated embodiment of FIG. 10, gap G formed therebetween is minimal, i.e., between about 1 mm and about 5 mm. In one embodiment, fastener 100 is a self tapping screw which attaches to the aluminum material of exterior threshold component 94, as shown in FIG. 10, such that astragal boot 58 is affixed to threshold 34 via exterior threshold component 94.

Fastener 100 can be selectively removed from threshold 34 (e.g. by unscrewing), which releases astragal boot 58 from its fixed position via exterior threshold component 94. When removed, astragal boot 58 can be disconnected from threshold 34 and set aside so that an unobstructed entryway surface across threshold 34 through enlarged fenestration $F_L$. This unobstructed surface facilitates ingress to and egress from building B. For example, with astragal boot 58 removed, dollies and hand trucks can be rolled into and out of building B over threshold 34 without obstruction. Astragal boot 58 can then be placed back into position and reattached by fastener 100 prior to closing sidelight 24 and realigning main astragal 56 with astragal boot 58.

Figure 10A:
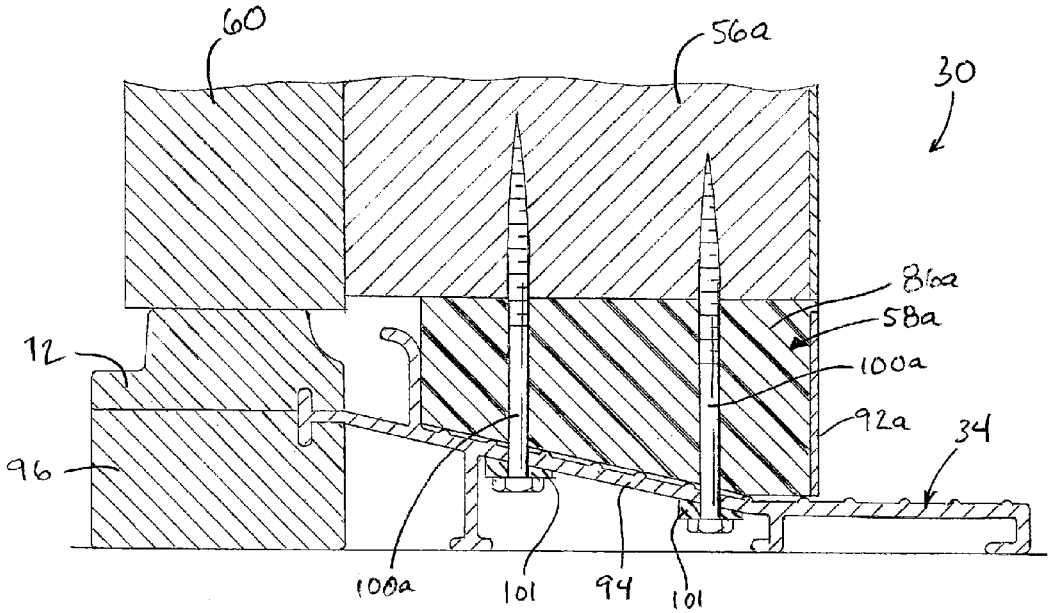
FIG. 10A is an elevation, partial cross-section view of the portion of the entryway assembly shown in FIG. 2, taken along line Xa-Xa of FIG. 2.

FIG. 10A illustrates fixed-side astragal boot 58*a* is illustrated in the context of its attachment to adjacent structures of entryway assembly 20. As shown, main body 86*a* of boot 58*a* has a shape and size similar to main body 86 of boot 58, except that main body 86*a* extends further upwardly to abut the lower surface of main astragal 56*a* as shown. Thus, no gap is formed between main astragal 56*a* and boot 58*a* such that main astragal 56*a* is physically supported by boot 58*a*. However, outer cladding 92*a* may stop short of contacting the corresponding outer cladding of main astragal 56*a*, such that a visual similarity between moveable and fixed astragals 28, 30 is provided (FIG. 2). Boot 58*a* and main astragal 56*a* may both be fixed to threshold 34 by fasteners 100*a* passed upwardly through exterior threshold component 94 and main body 86*a*, and into the lower portion of main astragal 56*a* as illustrated. Wedge-shaped washers 101 may be provided between the heads of fasteners 100*a* and the adjacent lower surface of exterior threshold component 94 to compensate for the angle therebetween. In the embodiment of FIGS. 10 and 10A, main astragals 56 and 56*a* may be provided as identical or mirror-image structures having corresponding lengths, such that main astragals 56 and 56*a* may be interchangeable between moveable and fixed astragals 28, 30.

Figure 13:
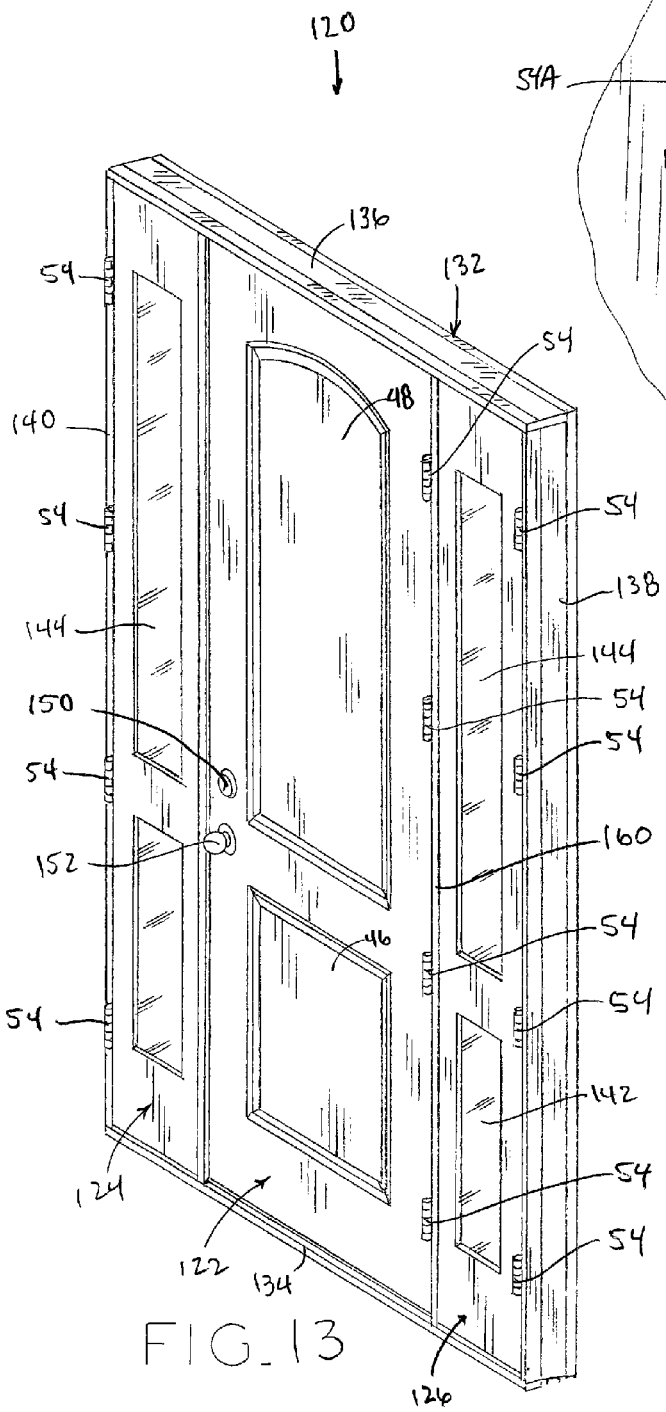
FIG. 13 is an interior perspective view of an alternative entryway assembly in accordance with the present disclosure, in which both sidelights flanking a main door are hinged to the door frame.

An alternative entryway assembly 120 is illustrated in FIG. 13. Alternative entryway assembly 120 has structures and functions substantially identical to entryway assembly 20 except as described below, and corresponding structures of alternative entryway assembly 120 are denoted by the same reference numerals as entryway assembly 20, except with 100 added thereto.

Unlike the fixed hinge-side sidelight 26 of assembly 20 (FIG. 3), hinge-side sidelight 126 is hinged to left side jamb 138 of door frame 132. Hinge-side sidelight 126 can therefore be swiveled between opened and closed positions in similar fashion to lock-side sidelight 124, with both sidelights 124, 126 interacting with door frame 132 and main door 122 to lock, seal, etc. in the same manner as sidelight 24 described in detail above.

Figure 15:
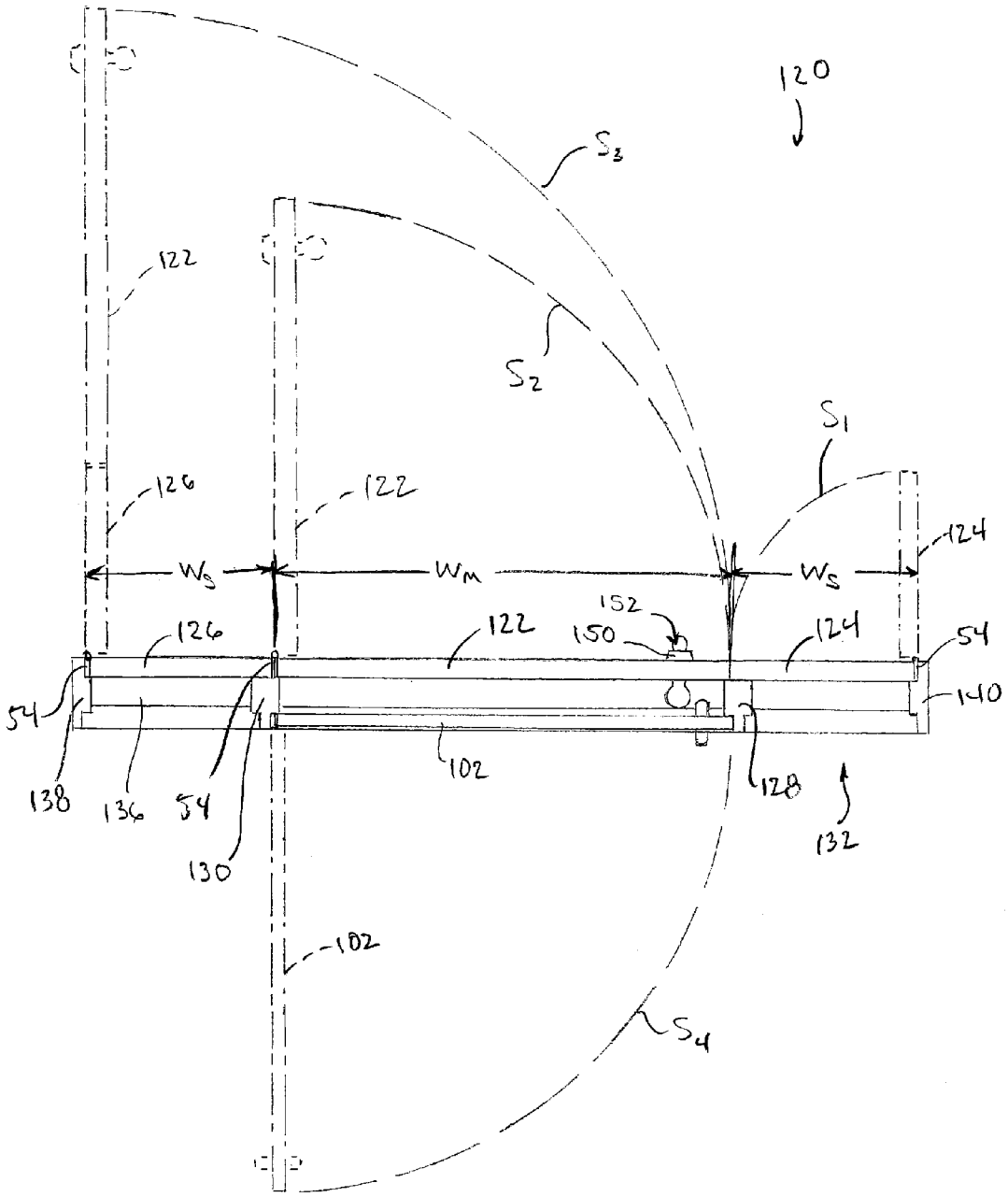
FIG. 15 is a plan view of the entryway assembly shown in FIG. 13, illustrating an swivel arc for each of various doors of the assembly.

Turning to FIG. 15, the swivel arcs of main door 122, lock-side sidelight 124 and the combination of main door 122 and hinge-side sidelight 126 are shown. As illustrated, sidelight 124 swivels about door hinges 54 to define swivel arc $S_1$, the same as sidelight 24. With hinge-side sidelight 126 in the closed and locked position, main door 122 swivels about swivel arc $S_2$, in identical fashion to main door 22. However, when hinge-side sidelight 126 is unlocked and able to swivel about door hinges 54 connected at left side jamb 138, main door 122 and sidelight 126 combine to form a larger main door (i.e., a main door assembly), which swivels about swivel arc $S_3$. In some embodiments, main door 122 and sidelight 126 may be fixed to one another, i.e., by fixing or otherwise disabling door hinges 54 connecting main door 122 and sidelight 126, so that the larger main door formed by the combination of main door 122 and sidelight 126 operates similarly to a monolithic main door. However, main door 122 and sidelight 126 can also operate as an enlarged main door while remaining hingedly connected to one another. Placing both lock-side sidelight 124 and hinge-side sidelight 126 in their respective unlocked and in the open positions (together with main door 122) exposes an even larger fenestration area having substantially the same width and overall area as door frame 132.

Main door 122 defines a main door width $W_M$, shown in FIG. 15, which is greater than width $W_S$ of sidelights 124, 126. In one embodiment, the width of main door 122 is about 36 inches, while sidelight width $W_S$ is about 14 inches. Similar door widths may be used for entryway assembly 20. Moreover, it is contemplated that any suitable dimensions of doors 22, 122 and sidelights 24, 26, 124, 126 may be used as required or desired for a particular application, including alternative industry-standard dimensions.

Referring still to FIG. 15, entryway assembly 120 may include storm door 102 hinged to astragal 130 at a hinged side and lockable to astragal 128 at a lock side. Storm door 102 can swivel through swivel arc $S_4$ toward the outside of building B, and may provide a weather barrier at the exterior of main door 122. Where storm door 102 is provided, astragals 128, 130 may be sized to extend sufficiently outwardly away from their respective mounting points at the outer surfaces of sidelights 126, 124 to create hinge-mounting and lock areas for storm door 102. In this embodiment, astragal boot 58 is similarly outwardly extended to present a flush and continuous outer surface of astragal assembly 128, similar to the flush outer surface illustrated in FIG. 10.

In another embodiment, astragals 128, 130 may include a separate piece of framework attached to their respective outer surfaces. In applications where the main bodies of astragals 128, 130 do not extend sufficiently outwardly to reach storm door 102, these framework pieces can be included to outwardly extend the astragal surfaces sufficiently to provide a mounting point for hinges and lock structures for storm door 102. These extra framework pieces may be aluminum, steel or polymer material formed, for example, by extruding material in a desired shape or by bending elongated strips of material into the desired shape. This shape may take the form of a "C" shaped channel or a "Z" shaped bracket, for example. These separate pieces of framework may be integrated into astragals 128, 130 by any suitable means, such as adhesive attachment, fasteners or welding. For purposes of the present disclosure, such framework pieces are considered a part of astragals 128, 130 after attachment. Astragal boot 58 may similarly include another separate piece of framework which aligns with the framework attached to astragal 128, in order to provide a consistent outward appearance as discussed in detail above.

Although storm door 102 is shown as part of entryway assembly 120, it is of course contemplated that storm door 102 may be used in conjunction with entryway assembly 20 in an identical fashion.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The following is claimed:

1. A building entryway assembly disposable between an interior and exterior of a building space, the assembly comprising:

a door frame positionable between the interior and the exterior of the building space, the door frame having upwardly extending first and second jambs, and a threshold and header extending between lower and upper ends of the first and second jambs respectively;

a main door having a hinge side and a lock side, the hinge side of the main door hinged to the first jamb to define a closed position in which the main door is substantially flush with the door frame and an open position in which the main door is swiveled into the interior of the building space;

a sidelight having a hinge side and a lock side, the hinge side of the sidelight hinged to the second jamb to define a closed position in which the sidelight is substantially flush with the door frame and an open position in which the sidelight is swiveled into the interior of the building space;

an astragal fixed to the lock side of the sidelight and protruding outwardly away from an outer surface of the sidelight; and an astragal boot fixed to the threshold of the door frame and positioned to align with the astragal when the sidelight is in the closed position.

2. The building entryway assembly of claim 1, wherein the astragal defines a transverse profile and the astragal boot defines a transverse profile that is the same as the transverse profile of the astragal.

3. The building entryway assembly of claim 1, wherein:

the main door defines a main door width between the lock side and the hinge side thereof; and the sidelight defines a sidelight width between the lock side and the hinge side thereof, the sidelight width less than the main door width.

4. The building entryway assembly of claim 1, wherein the main door comprises a main door assembly including a vent door and a second sidelight, the vent door hinged to the second sidelight such that the vent door is configured to be opened separately from the second sidelight or the main door assembly is configured to be opened as a single unit.

5. The building entryway assembly of claim 1, wherein the astragal boot is removably fixed to the threshold, such that the threshold presents an unobstructed entryway surface when the main door and the sidelight are in respective said open positions and the astragal boot is removed.

6. The building entryway assembly of claim 1, wherein the astragal boot comprises a main boot body and at least one boot cladding, the boot cladding having an appearance corresponding to the astragal such that the astragal cooperates with the astragal boot to present a consistent appearance from the threshold to the header when the sidelight is in the closed position.

7. The building entryway assembly of claim 1 further comprising a concealed hinge mounted to the hinge side of the sidelight and the second jamb, the concealed hinge not visible from the interior or the exterior of the building space when the sidelight is in the closed position.

8. The building entryway assembly of claim 1, wherein:

the threshold defines a downward slope extending away from the outer surface of the sidelight;

the astragal boot includes a sloped lower surface and a flat upper surface, the sloped lower surface corresponding to the downward slope of the threshold such that the flat upper surface is level; and the astragal having a flat lower surface which is adjacent to the flat upper surface when the sidelight is in the closed position such that the astragal and the astragal boot cooperate to form a continuous outer astragal surface.

9. The building entryway assembly of claim 1, further comprising a door seal mounted to the astragal adjacent the lock side of the sidelight, the door seal positioned to abut the outer surface of the main door when the main door and the sidelight are in respective said closed positions.

10. The building entryway assembly of claim 1, further comprising a second sidelight attached to the door frame at the first jamb, such that the second sidelight forms a fixed sidelight opposite and complementary to the sidelight hinged to the second jamb.

11. The building entryway assembly of claim 10, further comprising a storm door disposed outwardly of the main door, the storm door having a hinge side hinged to the second jamb and an opposing lock side positioned adjacent the astragal and the astragal boot when the storm door is in a closed position.

12. A door assembly comprising:

a door frame having a threshold with an outwardly extending, downwardly sloped surface;

a main door hinged to the door frame via a main hinge, the main door defining a closed position and an open position;

a sidelight mounted to the door frame via a sidelight hinge, the sidelight defining a closed position and an open position; and an astragal assembly comprising:

an astragal fixed to the sidelight and extending upwardly from a bottom surface of the sidelight to a top surface of the sidelight, the astragal protruding outwardly away from an outer surface of the sidelight and disposed between an interface of the main door and the sidelight when the main door and the sidelight are respectively in said closed positions; and an astragal boot fixed to the outwardly extending, downwardly sloped surface of the threshold, the astragal boot aligned with the astragal when the sidelight is in the closed position such that the astragal assembly is configured to extend from the threshold to an upper surface of the sidelight.

13. The door assembly of claim 12, wherein the main door defines a main door width and the sidelight defines a sidelight width less than the main door width.

14. The door assembly of claim 12, wherein the main door comprises a main door assembly including a vent door and a second sidelight, the vent door hinged to the second sidelight such that the vent door is configured to be opened separately from the second sidelight or the main door assembly is configured to be opened as a single unit.

15. The door assembly of claim 12, further comprising a fixed sidelight attached to the door frame opposite and complementary to the sidelight.

16. The door assembly of claim 12, wherein the astragal boot is removably fixed to the threshold, such that the threshold presents an uninterrupted entryway surface when the main door and the sidelight are in respective said open positions and the astragal boot is removed.

17. The door assembly of claim 12, wherein the sidelight hinge comprises a concealed hinge not visible when the sidelight is in the closed position.

18. A door assembly comprising:

a door frame having a first jamb, a second jamb, a sill, and a head;

a first panel having a first side hinged to the first jamb and a second side;

a second panel having a first side hinged to the second jamb and a second side positioned adjacent the second side of the first panel when the first and second panels are in respective closed positions, the second panel having an astragal member secured along the second side of the second panel;

an astragal boot secured between the astragal member of the second panel and the sill of the door frame; and wherein the first jamb includes a fixed astragal extending between the head and the sill of the door frame, the fixed astragal including a fixed-side astragal member extending downwardly from the head of the door frame and a fixed-side astragal boot extending upwardly from the sill of the door frame, the fixed-side astragal member having a length corresponding with the astragal member secured to the second side of the second panel, and the fixed-side astragal boot having secured the fixed-side astragal member, whereby the fixed astragal boot and fixed astragal member respectively match the astragal boot and the astragal member of the second panel in appearance when the second panel is in the closed position.

19. The door assembly of claim 18, wherein the astragal boot and the astragal member of the second panel have the same transverse profiles.

* * * * *